United States Patent [19]

Kunze et al.

[11] Patent Number: 4,474,045

[45] Date of Patent: Oct. 2, 1984

[54] SPRING GUIDE RAIL WITH SEVERAL CENTERING FINGERS

[75] Inventors: Lothar Kunze; Harald Vogt, both of Hofheim; Brün Stadler, Frankfurt am Main; Anton Herr, Kelkheim, all of Fed. Rep. of Germany

[73] Assignee: ITT Industries, Inc., New York, N.Y.

[21] Appl. No.: 495,315

[22] Filed: May 16, 1983

[30] Foreign Application Priority Data

Jun. 18, 1982 [DE] Fed. Rep. of Germany ..... 3222888

[51] Int. Cl.[3] ..... B21D 53/00

[52] U.S. Cl. ..... 72/379; 72/339

[58] Field of Search ..... 29/156.4 R; 418/266, 418/267; 267/150, 169, 178; 72/324, 332, 333, 72/335, 339, 379, 404

[56] References Cited

U.S. PATENT DOCUMENTS 2,004,555 6/1935 Kleinmann et al. ..... 72/335

3,073,020 1/1963 Reynolds ..... 72/378

FOREIGN PATENT DOCUMENTS 2205006 6/1978 Fed. Rep. of Germany ..... 418/266

*Primary Examiner*—Lowell A. Larson

*Attorney, Agent, or Firm*—James B. Raden; Marvin M. Chaban

[57] ABSTRACT

The spring guide rail has several centering fingers and a bottom rail and is made out of a one-piece sheet metal strip into which substantially rectangular recesses are punched so that a ladder-type structure is formed with a pair of longitudinal bars being interconnected by cross bars. By repeated bending operations around given longitudinal axes the two parts of the bottom rail are formed by the longitudinal bars and the centering fingers are formed by the cross bars. Between the sections of the cross bars folded to face each other there is a space and in the bottom rail area projections are arranged which ensure the spacing between the opposite parts of the bottom rail. Thus, a simple and stable spring guide rail with a safe guidance is provided for the vane lifting springs.

32 Claims, 3 Drawing Figures

SPRING GUIDE RAIL WITH SEVERAL CENTERING FINGERS

BACKGROUND OF THE INVENTION

The present invention relates to a spring guide rail with several centering fingers and a bottom rail for the guidance of the vane lifting springs and for the stroke limitation of the vanes of a rotary vane-type machine. The spring guide rail is shaped from a one-piece sheet metal strip, into which strip recesses of an essentially rectangular shape are punched so as to form a ladder-type structure with two longitudinal bars and with cross bars. From this ladder-type structure the spring guide rail is formed by means of repeated folding operations around longitudinal axes of the ladder-type structure, with the longitudinal bars of the ladder-type structure forming the two parts of the bottom rail and the cross bars forming the centering fingers.

In rotary vane-type machines, radially outwardly directed guide grooves are provided in a rotor and working vanes are arranged in these grooves. Compression springs supporting themselves at the bottom of the groove press the working vanes radially outwardly against a cam curve surrounding the rotor. The compression springs are arranged on the centering fingers of a spring guide rail so that the centering fingers penetrate the interior of the compression springs. The spring guide rail supports itself at the bottom of the groove by means of a bottom rail. The spring guide rail further limits the inward movement of the working vane by means of a mechanical stop.

A spring guide rail of the type referred to above is known from the German Patent DE-OS 1,653,923. In the spring guide rail disclosed therein the cross bar sections folded to face each other to form the centering fingers rest against each other. It is a disadvantage that the centering fingers have a rectangular transverse cross-section since an insufficient guide for the compression springs is provided thereby due to the circularity of the interior space of the compression springs. The centering fingers, and thus the spring guides further may easily be deformed upon the abutting action of the vane which will lead to operational disturbances up to total failure of the machine.

SUMMARY OF THE INVENTION

It is an object of the present invention to provide a simple and stable spring guide rail which will ensure a reliable guidance of the compression springs.

A feature of the present invention is the provision of a method of manufacturing a spring guide rail including a bottom rail and a plurality of centering fingers for guidance of vane lifting springs and for limiting this stroke of vanes of a rotary vane-type machine comprising the steps of providing a one-piece rectangular sheet metal strip; punching a plurality of essentially rectangular-shaped recesses in the strip to form a ladder-type structure having two spaced longitudinal bars and a plurality of parallel cross bars interconnecting the two longitudinal bars; folding the ladder-type structure about a first longitudinal axis equally spaced from and between the two longitudinal bars to provide each of the plurality of centering fingers by sections of each of the plurality of cross bars facing each other with a space therebetween; folding a first of the two longitudinal bars about a second longitudinal axis disposed at the junction of one end of the plurality of cross bars and the one of the two longitudinal bars to extend outward from the one end of the plurality of cross bars to provide a first part of the bottom rail; folding a second of the two longitudinal bars about a third longitudinal axis disposed at the junction of the other end of the plurality of cross bars and the other of the two longitudinal bars to extend outward from the other end of the plurality of cross bars to provide a second part of the bottom rail; and forming a plurality of projections on at least one of the two longitudinal bars to maintain the space between the sections of each of the plurality of cross bars forming each of the plurality of centering fingers. An even and stable guidance of the vane lifting springs will be achieved due to the space between the opposingly folded sections of the cross bars forming the centering fingers. The projections arranged at the bottom rail ensure that the space will be maintained even during operation.

A further feature of the invention provides that the projections project into the interior space of the punched recesses of the punched component. After the folding or rather the bending operation the projections will rest at the respective opposite part of the bottom rail.

It will be expedient to arrange the projections on only one part of the total length of the shorter rectangular side of the recess.

It will be favorable in terms of manufacture to arrange the projections on only one of the shorter rectangular sides of the recess. This does also apply to the arrangement of the projections on one of the two longitudinal bars and on each of the shorter rectangular sides of the recess.

If the cross-section of the cross bars is enlarged where they pass over into the longitudinal bars, the finished bent spring guide rail will have a greater flexural strength and thus a greater resistance to deformation in the area where the centering fingers pass over into the bottom rail.

In the middle, the cross-section of the cross bars is expediently diminished by means of neckings so that the assembly part will have a transition region of smaller cross-section at the upper end of the centering fingers.

A particularly advantageous embodiment provides that the areas of the opposingly folded sections of the cross bars, along which the vane lifting springs are guided, are rounded off. This will improve the guidance. Sharp edges causing damages to the vane lifting springs do not exist any longer. It will be advantageous in terms of manufacture to produce the rounded-off areas by plastic deformation before the folding operation.

BRIEF DESCRIPTION OF THE DRAWING

Above-mentioned and other features and objects of this invention will become more apparent by reference to the following description taken in conjunction with the accompanying drawings, in which.

DESCRIPTION OF THE PREFERRED EMBODIMENT

Figure 1:
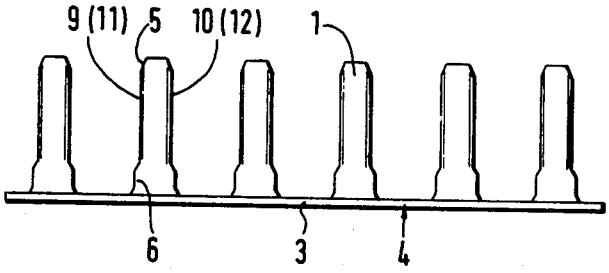
FIG. 1 is a side view of the spring guide rail.
Figure 2:
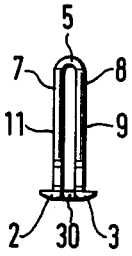
FIG. 2 is an end view of the spring guide rail of FIG. 1.

The spring guide rail has several centering fingers 1. At their lower ends, as seen in FIGS. 1 and 2, there are two parts 2 and 3 of a bottom rail 4 which is common to all the centering fingers 1. At their upper ends the centering fingers have a transition region 5 of smaller cross-section and at their lower ends, near the transition into the bottom rail 4, they have a transition region 6 of larger cross-section. The centering fingers 1 are formed by sheet metal strip sections 7 and 8 folded to face each other and spaced with respect to each other. This results in an essentially square transverse cross-section of the centering fingers 1. The longitudinally extending edges 9 through 12 of the centering fingers 1 are rounded off for the purpose of improved guidance and durability of the vane lifting springs. The parts 2 and 3 of the bottom rail 4 are partially rounded off at their lower ends.

Figure 3:
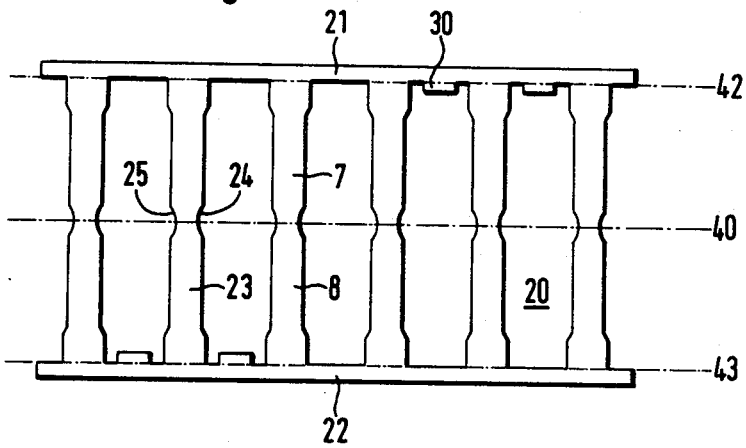
FIG. 3 is the spring guide rail of FIG. 1 before the folding and/or bending operation.

FIG. 3 represents the developed view of the spring guide rail. Punched into a sheet metal strip are essentially rectangular recesses 20, thus resulting in a ladder-type structure with two longitudinal bars 21 and 22 and several cross bars 23 interconnecting bars 21 and 22. In the middle of the cross bars there are neckings 24 and 25 which in the finished bent part form the transition region 5 of smaller cross-section at the upper end of the centering fingers 1.

The cross-section of the cross bars 23 is enlarged where they pass over into the longitudinal bars 21 and 22 so that this transition region 6 of the assembly has an increased resistance to deformation.

The mutual spacing of the cross bar sections 7 and 8 folded to face each other will be ensured by projections 30 (FIG. 2) in the area of the bottom rail 4. As shown in FIG. 3, projections 30 project into the punched recess 20. Th projections 30 are each arranged on only one of the short sides of the punched rectangular recesses 20.

The sheet metal part whose developed view is represented in FIG. 3 is bent along the dash-dotted line 40 by 180°, thus the sections 7 and 8 of each cross bar 23 lie opposite each other in a spaced relationship. Along the dash-dotted line 42, 43 a bending by 90° is effected so that the parts 2 and 3 of the bottom rail 4 point outwards and the respective projection 30 bridges and maintains the space between the sections 7 and 8 folded to face each other.

While we have described above the principles of our invention in connection with specific apparatus, it is to be clearly understood that this description is made only by way of example and not as a limitation to the scope of our invention as set forth in the objects thereof and in the accompanying claims.

We claim:

1. A method of manufacturing a spring guide rail including a bottom rail and a plurality of centering fingers for guidance of vane lifting springs and for limiting the stroke of vanes of a rotary vane-type machine comprising the steps of:

providing a one-piece rectangular sheet metal strip;

punching a plurality of essentially rectangular shaped recesses in said strip to form a ladder-type structure having two spaced longitudinal bars and a plurality of parallel cross bars interconnecting said two longitudinal bars;

folding said ladder-type structure about a first longitudinal axis equally spaced from and between said two longitudinal bars to provide each of said plurality of centering fingers by sections of each of said plurality of cross bars facing each other with a space therebetween;

folding a first of said two longitudinal bars about a second longitudinal axis disposed at the junction of one end of said plurality of cross bars and said one of said two longitudinal bars to extend outward from said one end of said plurality of cross bars to provide a first part of said bottom rail;

folding a second of said two longitudinal bars about a third longitudinal axis disposed at the junction of the other end of said plurality of cross bars and said other of said two longitudinal bars to extend outward from said other end of said plurality of cross bars to provide a second part of said bottom rail; and forming a plurality of projections on at least one of said two longitudinal bars to maintain said space between said sections of each of said plurality of cross bars forming each of said plurality of centering fingers.

2. A method according to claim 1, wherein each of said plurality of projections project into a different one of said plurality of recesses prior to said step of folding said one of said two longitudinal bars.

3. A method according to claim 2, wherein each of said plurality of projections are disposed on only a part of the total length of one shorter side of an associated one of said plurality of recesses.

4. A method according to claim 2, wherein each of said plurality of projections are disposed on only one shorter side of an associated one of said plurality of recesses.

5. A method according to claim 2, wherein said step of forming includes a step of forming certain of said plurality of projections on said one of said two longitudinal bars, and a step of forming others of said plurality of projections on the other of said two longitudinal bars.

6. A method according to claim 5, wherein each of said plurality of projections are disposed on one shorter side of an associated one of said plurality of recesses,

7. A method according to claim 5, wherein said step of punching includes a step of enlarging the transverse cross section of each of said plurality of cross bars adjacent said second and third axes.

8. A method according to claim 7, wherein said step of punching further includes a step of reducing the transverse cross section of each of said plurality of cross bars adjacent said first axis.

9. A method according to claim 8, wherein said step of punching further includes a step of plastically deforming said plurality of cross bars to round off said sections of each of said plurality of cross bars.

10. A method according to claim 5, wherein said step of punching includes a step of reducing the transverse cross section of each of said plurality of cross bars adjacent said first axis.

11. A method according to claim 10, wherein said step of punching further includes a step of plastically deforming said plurality of cross bars to round off said sections of each of said plurality of cross bars.

12. A method according to claim 5, wherein said step of punching includes a step of plastically deforming said plurality of cross bars to round off said sections of each of said plurality of cross bars.

13. A method according to claim 2, wherein said step of punching includes a step of enlarging the transverse cross section of each of said plurality of cross bars adjacent said second and third axes.

14. A method according to claim 13, wherein said step of punching further includes a step of reducing the transverse cross section of each of said plurality of cross bars adjacent said first axis.

15. A method according to claim 14, wherein said step of punching further includes a step of plastically deforming said plurality of cross bars to round off said sections of each of said plurality of cross bars.

16. A method according to claim 2, wherein said step of punching includes a step of reducing the transverse cross section of each of said plurality of cross bars adjacent said first axis.

17. A method according to claim 16, wherein said step of punching further includes a step of plastically deforming said plurality of cross bars to round off said sections of each of said plurality of cross bars.

18. A method according to claim 2, wherein said step of punching includes a step of plastically deforming said plurality of cross bars to round off said sections of each of said plurality of cross bars.

19. A method according to claim 1, wherein said step of forming incudes a step of forming certain of said plurality of projections on said one of said two longitudinal bars, and a step of forming others of said plurality of projections on the other of said two longitudinal bars.

20. A method according to claim 19, wherein each of said plurality of projections are disposed on one shorter side of an associated one of said plurality of recesses.

21. A method according to claim 19, wherein said step of punching includes a step of enlarging the transverse cross section of each of said plurality of cross bars adjacent said second and third axes.

22. A method according to claim 21, wherein said step of punching further includes a step of reducing the transverse cross section of each of said plurality of cross bars adjacent said first axis.

23. A method according to claim 22, wherein said step of punching further includes a step of plastically deforming said plurality of cross bars to round off said sections of each of said plurality of cross bars.

24. A method according to claim 19, wherein said step of punching includes a step of reducing the transverse cross section of each of said plurality of cross bars adjacent said first axis.

25. A method according to claim 24, wherein said step of punching further includes a step of plastically deforming said plurality of cross bars to round off said sections of each of said plurality of cross bars.

26. A method according to claim 19, wherein said step of punching inluces a step of plastically deforming said plurality of cross bars to round off said sections of each of said plurality of cross bars.

27. A method according to claim 1, wherein said step of punching includes a step of enlarging the transverse cross section of each of said plurality of cross bars adjacent said second and third axes.

28. A method according to claim 27, wherein said step of punching further includes a step of reducing the transverse cross section of each of said plurality of cross bars adjacent said first axis.

29. A method according to claim 28, wherein said step of punching further includes a step of plastically deforming said plurality of cross bars to round off said sections of each of said plurality of cross bars.

30. A method according to claim 1, wherein said step of punching includes a step of reducing the transverse cross section of each of said plurality of cross bars adjacent said first axis.

31. A method according to claim 30, wherein said step of punching further includes a step of plastically deforming said plurality of cross bars to round off said sections of each of said plurality of cross bars.

32. A method according to claim 1, wherein said step of punching includes a step of plastically deforming said plurality of cross bars to round off said sections of each of said plurality of cross bars.

* * * * *